US009561655B2

(12) United States Patent
Tamai et al.

(10) Patent No.: US 9,561,655 B2
(45) Date of Patent: Feb. 7, 2017

(54) LIQUID DISCHARGING HEAD, LIQUID DISCHARGING UNIT, AND DEVICE TO DISCHARGE LIQUID

(71) Applicants: Tomohiro Tamai, Kanagawa (JP); Toshiroh Tokuno, Tokyo (JP)

(72) Inventors: Tomohiro Tamai, Kanagawa (JP); Toshiroh Tokuno, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/996,569

(22) Filed: Jan. 15, 2016

(65) Prior Publication Data

US 2016/0207311 A1 Jul. 21, 2016

(30) Foreign Application Priority Data

Jan. 16, 2015 (JP) ..... 2015-006344
Sep. 29, 2015 (JP) ..... 2015-191675

(51) Int. Cl.
*B41J 2/16* (2006.01)
*B41J 2/14* (2006.01)
*B41J 2/165* (2006.01)

(52) U.S. Cl.
CPC ..... *B41J 2/1433* (2013.01); *B41J 2/14274* (2013.01); *B41J 2/162* (2013.01); *B41J 2/1606* (2013.01); *B41J 2/1612* (2013.01); *B41J 2/1623* (2013.01); *B41J 2/1625* (2013.01); *B41J 2/1632* (2013.01)

(58) Field of Classification Search
CPC ..... B41J 2/1606
See application file for complete search history.

(56) References Cited

U.S. PATENT DOCUMENTS 5,581,285 A * 12/1996 Watanabe ..... B41J 2/1606 347/45
5,797,778 A * 8/1998 Ito ..... B63H 21/305 440/111
2003/0197758 A1 10/2003 Sasaki et al.
2004/0223033 A1 11/2004 Sasaki et al.
2006/0209117 A1* 9/2006 Parazak ..... B41J 2/1606 347/21
2009/0195605 A1* 8/2009 Yanata ..... B41J 2/1433 347/47
2010/0053269 A1* 3/2010 Fujii ..... B41J 2/1606 347/45

FOREIGN PATENT DOCUMENTS

JP 2004-001494 1/2004
JP 2004-330681 11/2004
JP 2011-194668 10/2011
JP 2013-237259 11/2013
WO WO 99/15337 A1 4/1999

* cited by examiner

*Primary Examiner* — Shelby Fidler
(74) *Attorney, Agent, or Firm* — Cooper & Dunham LLP

(57) ABSTRACT

A liquid discharging head includes a nozzle plate including a nozzle substrate having a plurality of nozzle holes to discharge a liquid therethrough and a plurality of dimples on the discharging surface of the nozzle substrate to hold a liquid repellent material inside the plurality of dimples in a flowable manner and a liquid repellency film formed by the liquid repellent material on the discharging surface of the nozzle substrate.

11 Claims, 13 Drawing Sheets

FIG. 13

| | |
|---|---|
| UPSTREAM PROCESS | POLISH SURFACE OF NOZZLE SUBSTRATE |
| PRE-PROCESSING PROCESS | ULTRASONIC WAVE CLEANING OF SURFACE OF NOZZLE SUBSTRATE |
| FILM-FORMING PROCESS OF LIQUID REPELLENCY FILM | DIPPING LIQUID PREPARATION FOR LIQUID REPELLENCY FILM |
| | PLASM TREATMENT OF SURFACE (DISCHARGING SURFACE) OF NOZZLE SUBSTRATE |
| | DIPPING IN DIPPING LIQUID FOR LIQUID REPELLENCY FILM |
| | LEFT AT NORMAL TEMPERATURE |
| | HEATING |
| | ULTRASONIC WAVE CLEANING |
| POST-PROCESSING PROCESS | LAMINATE PROTECTION OF SURFACE OF LIQUID REPELLENCY FILM |
| | PLASM TREATMENT OF SURFACE (DISCHARGING SURFACE) OF NOZZLE SUBSTRATE |
| DOWNSTREAM PROCESS | ATTACHMENT TO FLOW PATH PLATE |
| | HEATING AFTER ATTACHMENT |

FIG. 14

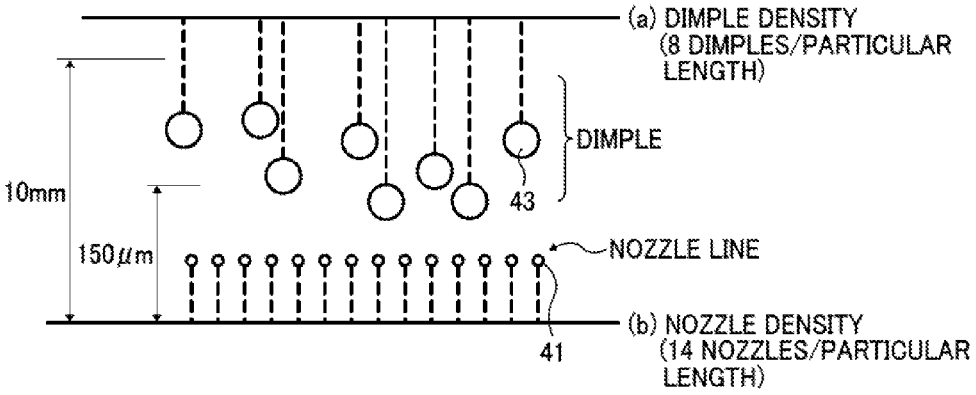

FIG. 15

| | EXAMPLE 1 | EXAMPLE 2 | EXAMPLE 3 | COMPARATIVE EXAMPLE 1 | COMPARATIVE EXAMPLE 2 | COMPARATIVE EXAMPLE 3 |
|---|---|---|---|---|---|---|
| CONTENT RATIO OF COARSE ALUMINA PARTICLE IN POLISH LIQUID | 5 % | 11 % | 16 % | LESS THAN 1 % | 11 % | 11 % |
| SURFACE ROUGHNESS Ra OF FLAT PORTION OTHER THAN DIMPLE | 0.03 μm | 0.03 μm | 0.03 μm | 0.03 μm | 0.7 μm | 1.2 μm |
| WHETHER THERE IS A DIMPLE | YES | YES | YES | NO | NO | NO |
| DIMPLE GRADE | 2 | 3 | 5 | 0 | 0 | 0 |
| DURABILITY LIFE (NUMBER OF TIMES) OF WIPING | 2500 | 2800 | 4000 | LESS THAN 2000 | LESS THAN 2000 | LESS THAN 2000 |

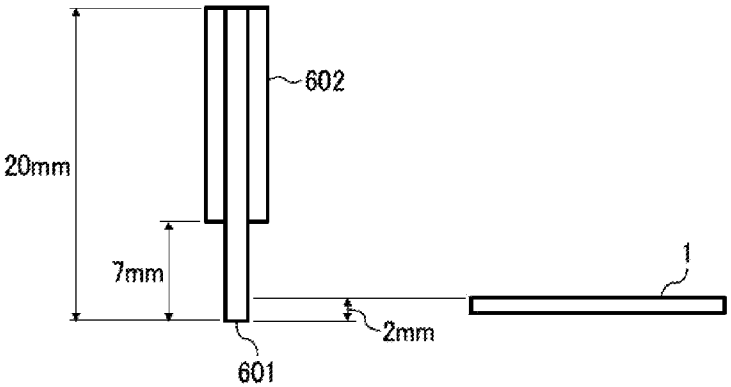
FIG. 16
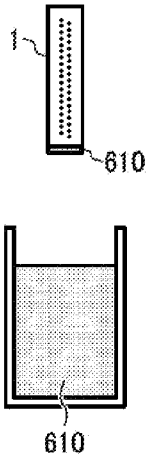
FIG. 17A
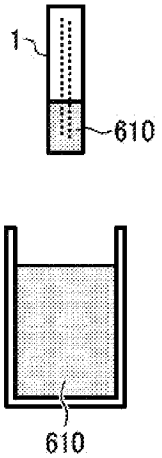
FIG. 17B
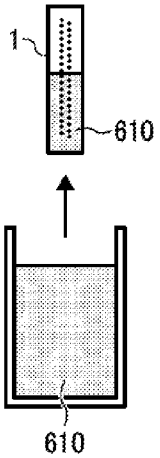
FIG. 17C
FIG. 17D
FIG. 17E

LIQUID DISCHARGING HEAD, LIQUID DISCHARGING UNIT, AND DEVICE TO DISCHARGE LIQUID

CROSS-REFERENCE TO RELATED APPLICATIONS

This patent application is based on and claims priority pursuant to 35 U.S.C. §119 to Japanese Patent Application No. 2015-006344 and 2015-191675 on Jan. 16, 2015 and Sep. 29, 2015, respectively, in the Japan Patent Office, the entire disclosures of which are hereby incorporated by reference herein.

BACKGROUND

Technical Field

The present invention relates to a liquid discharging head, a liquid discharging unit, and a device to discharge liquid.

Background Art

A liquid repellent film is formed on the side of the discharging surface of the nozzle plate of a liquid discharging head (also referred to as droplet discharging head) to stably discharge a liquid.

As for a device to discharge a liquid using a liquid discharging head, the discharging surface is wiped by a blade to maintain and restore the discharging performance of the liquid discharging head.

As a result, the water repellent film is abraded by repetition of the wiping, thereby degrading the liquid repellency thereof.

SUMMARY

According to the present invention, provided is an improved liquid discharging head having a nozzle plate including a nozzle substrate having a plurality of nozzle holes to discharge a liquid therethrough and a plurality of dimples on the discharging surface of the nozzle substrate to hold a liquid repellent material inside the plurality of dimples in a flowable manner and a liquid repellency film formed by the liquid repellent material on the discharging surface of the nozzle substrate.

BRIEF DESCRIPTION OF THE SEVERAL VIEWS OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein:

FIG. 13 is a table illustrating an example of the method of manufacturing the nozzle plate;

FIG. 14 is a diagram illustrating dimple grades in Examples and Comparative Examples described later;

FIG. 15 is a table for use in a description of Examples and Comparative Examples described later;

FIG. 16 is a diagram illustrating a wiping member (wiper) for use in measuring the wiping durability;

FIGS. 17A, 17B, 17C, 17D, and 17E are diagrams illustrating an example of a measuring method of ink leaving time of the nozzle plate after wiping;

DETAILED DESCRIPTION

Figure 1:
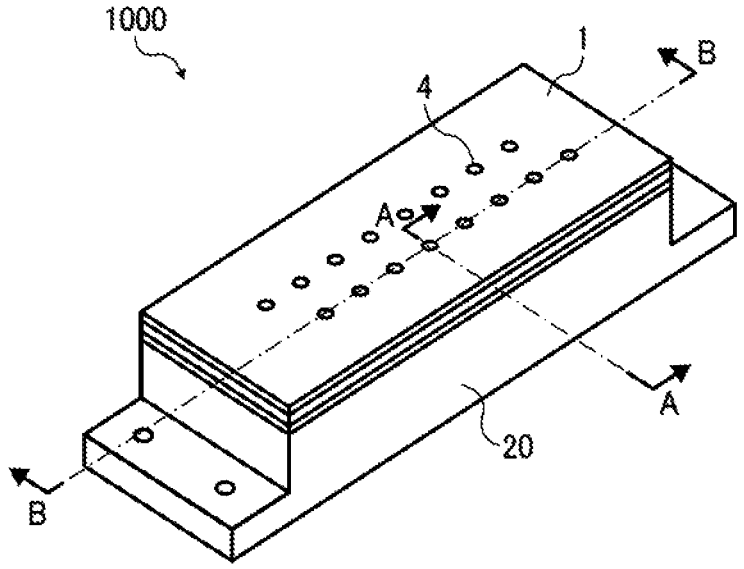
FIG. 1 is a perspective diagram illustrating an example of the outlook of the liquid discharging head according to an embodiment of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

In the following description, illustrative embodiments will be described with reference to acts and symbolic representations of operations (e.g., in the form of flowcharts) that may be implemented as program modules or functional processes including routines, programs, objects, components, data structures, etc., that perform particular tasks or implement particular abstract data types and may be implemented using existing hardware at existing network elements or control nodes. Such existing hardware may include one or more Central Processing Units (CPUs), digital signal processors (DSPs), application-specific-integrated-circuits, field programmable gate arrays (FPGAs) computers or the like. These terms in general may be referred to as processors.

Unless specifically stated otherwise, or as is apparent from the discussion, terms such as "processing" or "computing" or "calculating" or "determining" or "displaying" or the like, refer to the action and processes of a computer system, or similar electronic computing device, that manipulates and transforms data represented as physical, electronic quantities within the computer system's registers and memories into other data similarly represented as physical quantities within the computer system memories or registers or other such information storage, transmission or display devices.

Preferred embodiments of the present invention are described in detail below with reference to the accompanying drawings. Although the presently preferred embodiments of the present invention are described with various technically preferred limitations, the scope of the invention should not be construed as limited by the embodiments discussed below. It should not be construed that all of elements of the embodiments discussed below are essential to the invention unless specifically stated as such According to the present disclosure, degradation of the liquid repellency over time is subdued.

Figure 2:
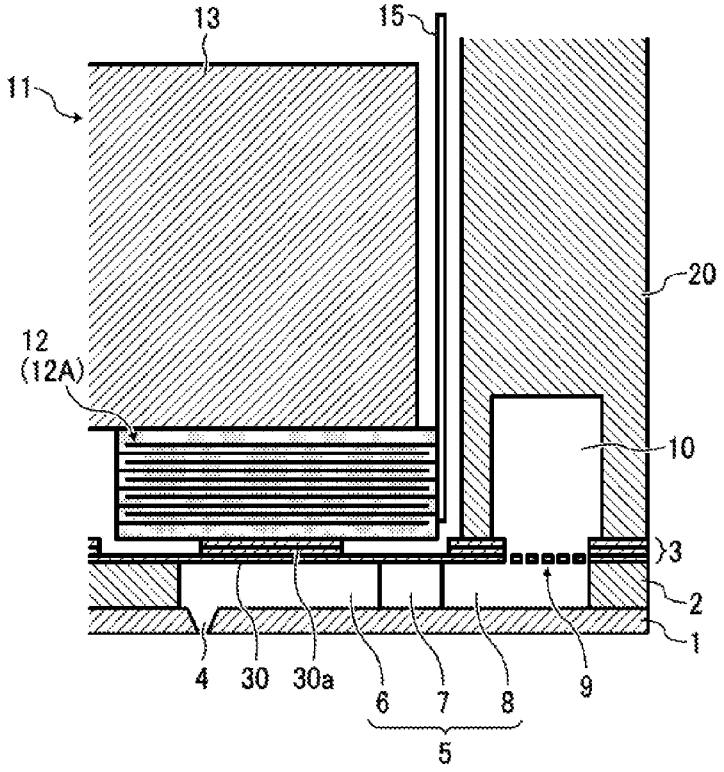
FIG. 2 is a cross section illustrating the liquid discharging head relative to a direction (longitudinal direction of liquid chamber) vertical to the nozzle arrangement direction along the line A-A illustrated in FIG. 1.
Figure 3:
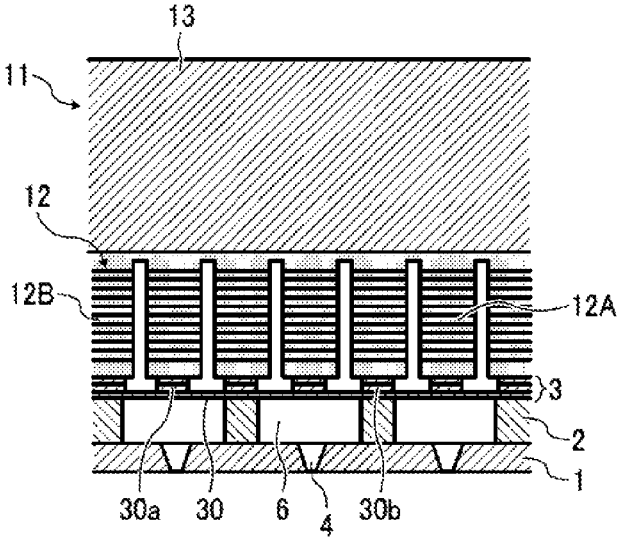
FIG. 3 is a cross section illustrating the liquid discharging head relative to the nozzle arrangement direction (transverse direction of liquid chamber) along the line B-B illustrated in FIG. 1.

Embodiments of the present disclosure are described with reference to the accompanying drawings. An example of the liquid discharging head relating to the present disclosure is described with reference to FIG. 1 to FIG. 3. FIG. 1 is a prospective view illustrating the outlook of a liquid discharging head 1000, FIG. 2 is a cross section illustrating the liquid discharging head 1000 relative to a direction (longitudinal direction of liquid chamber) vertical to the nozzle arrangement direction along the line A-A illustrated in FIG. 1; and FIG. 3 is a cross section illustrating the liquid discharging head 1000 relative to the nozzle arrangement direction (transverse direction of liquid chamber) along the line B-B illustrated in FIG. 1.

In the liquid discharging head 1000, a nozzle plate 1, a flow path plate 2, and a vibration plate member 3 as a wall member are attached to and laminated on each other. Also, it includes a piezoelectric actuator 11 to displace the vibration plate member 3 and a frame member 20 as a common liquid chamber member.

The nozzle plate 1, the flow path plate 2, and the vibration plate member 3 form an individual flow path 5 communicating with multiple nozzles 4 through which a liquid is discharged. The individual flow path 5 is formed of an individual liquid chamber 6 communicated with the nozzle 4, a flow resistance part 7 to supply the liquid to the individual liquid chamber 6, and a liquid introduction part 8 that communicates with the flow resistance part 7. These are sequentially arranged from downstream when the nozzle 4 is defined to be on the downstream side.

The liquid is introduced from a common liquid chamber 10 serving as the common flow path of the frame member 20 into the individual flow path 5 via an introduction mouth (supplying mouth) 9 formed on the vibration plate member 3, and thereafter to the individual liquid chamber 6 via the liquid introduction part 8 and the flow resistance part 7. A filter may be optionally provided to the introduction mouth 9.

The nozzle plate 1 is made by forming the nozzle 4 on a SUS substrate serving as the nozzle substrate by pressing process and a liquid repellent film is formed on the discharging surface of the nozzle plate 1, which is described later.

The flow path plate 2 forms a piercing part (or ditch part) that forms the individual flow path 5 including the individual liquid chamber 6, the flow resistance part 7, and the liquid introduction part 8 by etching the SUS substrate.

The vibration plate member 3 is a wall member forming the wall of the individual liquid chamber 6 of the flow path plate 2. This vibration plate member 3 is three-layered (single-layered, double-layered, or four- or more-layered is also possible).

When the layer on the side of the flow path plate 2 is defined as the first layer, the first layer forms a transformable vibration area (vibration plate) 30 at the portion corresponding to the individual liquid chamber 6.

The vibration plate member 3 is made of a metal plate of nickel and manufactured by an electroforming method (electrocasting). The vibration plate member 3 can be made by another metal, resin, or a laminating member of a resin layer and a metal layer.

On the opposite side of the individual liquid chamber 6 of the vibration plate member 3, there is arranged the piezoelectric actuator 11 including an electromechanical transducer element as a driving device (e.g., actuator, pressure generator) to transform the vibration area of the vibration plate member 3.

This piezoelectric actuator 11 includes multiple laminate type piezoelectric members 12 attached to a base member 13 with an adhesive. The laminate type piezoelectric member 12 is grooved by half cut dicing and a particular number of piezoelectric elements (piezoelectric pillar) 12A and 12B having a pillar-like form are formed on the laminate type piezoelectric member 12 in a pectinate manner spaced a predetermined distance therebetween.

Although the piezoelectric elements 12A and 12B of the piezoelectric element 12 are the same, the piezoelectric element 12A is driven by a drive waveform and the piezoelectric element 12B is not driven by a drive waveform but simply used as a pillar.

The piezoelectric element 12A is jointed to a convex part 30*a*, which is a thick part having an island-like form formed on the vibration area 30 of the vibration plate member 3. The piezoelectric element 12B is jointed to a convex part 30*b*, which is a thick part of the vibration plate member 3.

This piezoelectric element 12 is manufactured by alternately laminating piezoelectric layers and inside electrodes. The inside electrode is drawn to the end surface to form an exterior electrode. The piezoelectric element 12 is connected with an FPC 15 serving as a flexible wiring member having flexibility to impart a drive signal to the exterior electrode of the piezoelectric element 12A.

The frame member 20 is manufactured by injection molding with, for example, an epoxy-based resin or polyphenylene sulfite as a thermoplastic resin and includes the common liquid chamber 10 where the liquid is supplied from a head tank or a liquid cartridge.

In the liquid discharging head 1000 having such a configuration, the piezoelectric element 12A contracts by, for example, lowering the voltage applied to the piezoelectric element 12A from a reference voltage. For this reason, the vibration area 30 of the vibration plate member 3 is lowered, thereby inflating the volume of the individual liquid chamber 6 so that the liquid flows into the individual liquid chamber 6.

Thereafter, the piezoelectric element 12A is elongated in the lamination direction by raising the voltage applied to the piezoelectric element 12A to transform the vibration area 30 of the vibration plate member 3 toward the nozzle 4 direction, thereby contracting the volume of the individual liquid chamber 6. For this reason, the liquid in the liquid chamber 6 is pressurized so that the liquid is discharged (jetted) through the nozzle 4.

Thereafter, the voltage applied to the piezoelectric element 12A is returned to the reference voltage. Accordingly, the vibration area 30 of the vibration plate member 3 is back to the initial position so that the individual liquid chamber 6 inflates, which generates a negative pressure. At this point in time, the liquid is supplied from the common liquid chamber 10 to the individual liquid chamber 6. After the vibration of the meniscus surface of the nozzle 4 decays and is stabilized, the system starts behaviors to discharge the next droplet.

The drive method of the head is not limited to the above-mentioned (pull-push discharging). The way of discharging changes depending on how a drive waveform is imparted.

Figure 4:
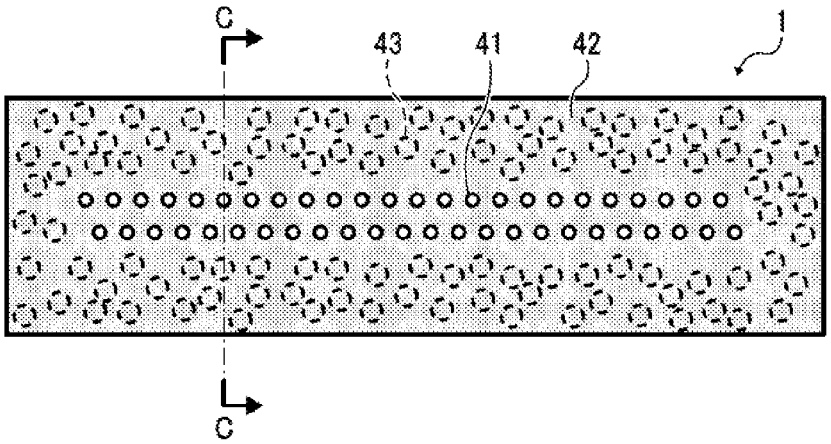
FIG. 4 is a planar diagram illustrating the nozzle plate according to a first embodiment of the present disclosure.
Figure 5:
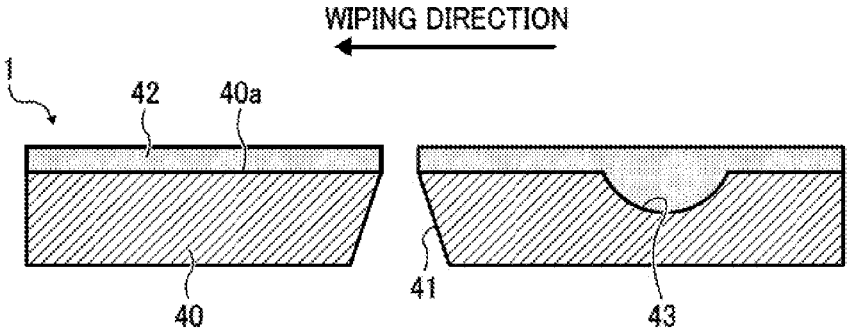
FIG. 5 is an enlarged cross section illustrating the liquid discharging head along the line C-C illustrated in FIG. 4.
Figure 6:
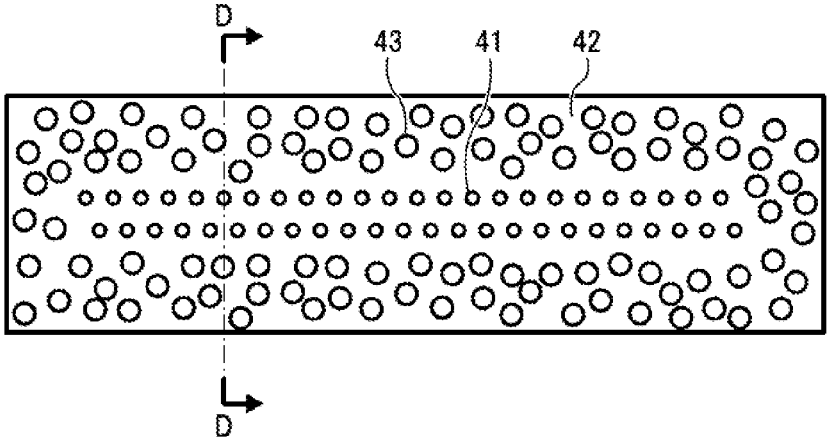
FIG. 6 is a planar diagram of the nozzle substrate of the nozzle plate illustrated in FIG. 4.
Figure 7:
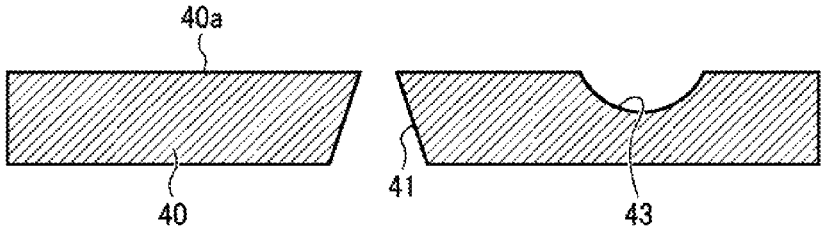
FIG. 7 is an enlarged cross section illustrating the liquid discharging head along the line D-D illustrated in FIG. 6.
Figure 8:
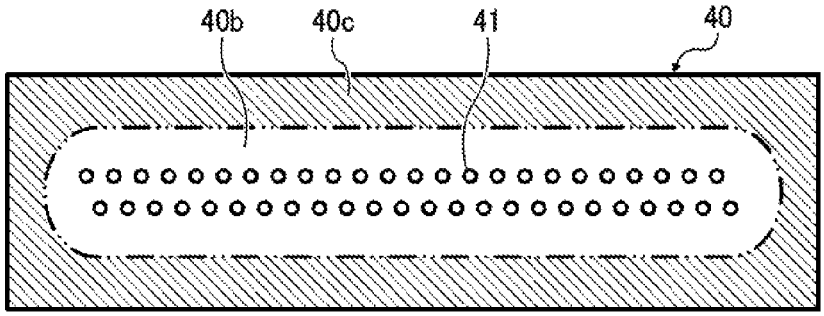
FIG. 8 is a planar diagram illustrating the forming area of the dimples of the nozzle substrate.

Next, the first embodiment of the present disclosure will be described with reference to FIG. 4 to FIG. 8. FIG. 4 is a planar diagram illustrating the nozzle plate in the first embodiment. FIG. 5 is an enlarged cross section of the nozzle plate along the line C-C drawn in FIG. 4. FIG. 6 is a planar diagram illustrating the nozzle substrate of the nozzle plate. FIG. 7 is an enlarged cross section of the nozzle plate along the line D-D drawn in FIG. 6. FIG. 8 is a planar diagram illustrating the forming area of dimples on the nozzle substrate.

The nozzle plate 1 has a nozzle substrate 40 on which multiple nozzle holes 41 are formed serving as the nozzle 4 through which the liquid is discharged. A liquid repellency film 42 is formed on the side of a discharging surface 40*a* of the nozzle substrate 40.

The nozzle substrate 40 is made of a metal plate such as SUS substrate. The nozzle holes 41 are formed by pressing process and smoothed by polishing. The cross section form of the nozzle hole 41 is not particularly limited.

The nozzle substrate 40 can be made of, for example, Al, Bi, Cr. InSn, ITO, Nb, $Nb_2O_5$, NiCr, Si, $SiO_2$, Sn, $Ta_2O_5$, Ti, W, ZAO ($ZnO+Al_2O_3$), and Zn. Also a substrate on which a layer of these is formed can be used instead of SUS substrate.

The liquid repellency film 42 is formed on the discharging surface 40*a* of the nozzle substrate 40 using a liquid repellent material, which is a compound having a perfluoropolyether (PFPE) skeleton in its molecule.

On the discharging surface 40*a* of the nozzle substrate 40, multiple dimples 43 are formed. The arrangement of the dimple 43 is simplified for illustration in each drawing. However, a great number of dimples 43 are formed around the nozzle lines having multiple nozzles 4.

The dimple 43 has a larger diameter than the nozzle hole 41. In addition, the wall of the dimple 43 is preferably curved. In addition, the dimple 43 is formed in an area 40*c* except an area 40*b* formed around the nozzle hole 41 as illustrated in FIG. 8. Specifically, the dimple 43 is preferably formed at a position at least 150 μm away from the center of the nozzle hole 41.

In addition, the surface roughness Ra of the nozzle substrate 40 affected by the formation of the dimple 43 is 0.1 μm or less.

A liquid repellent material having flowability such as the compound having a perfluoropolyether (PFPE) skeleton in its molecule is applied to the discharging surface 40*a* of the nozzle substrate 40 to form a liquid repellency film 42.

The liquid repellent material forming the liquid repellency film 42 is held inside the dimple 43 in a flowable manner.

That is, inside the dimple 43, the molecule of the liquid repellency film 42 bonds with the nozzle substrate 40 on the interface side with the nozzle substrate 40 but the molecule situated (on the surface side of the liquid repellency film 42, and between the surface of the liquid repellency film 42 and the interface with the nozzle substrate 40) other than the interface with the nozzle substrate 40 is isolated. The interface with the nozzle substrate 40 represents the interface with the base coat layer when the nozzle substrate 40 includes a base coat layer as in the embodiments described later.

Figure 9:
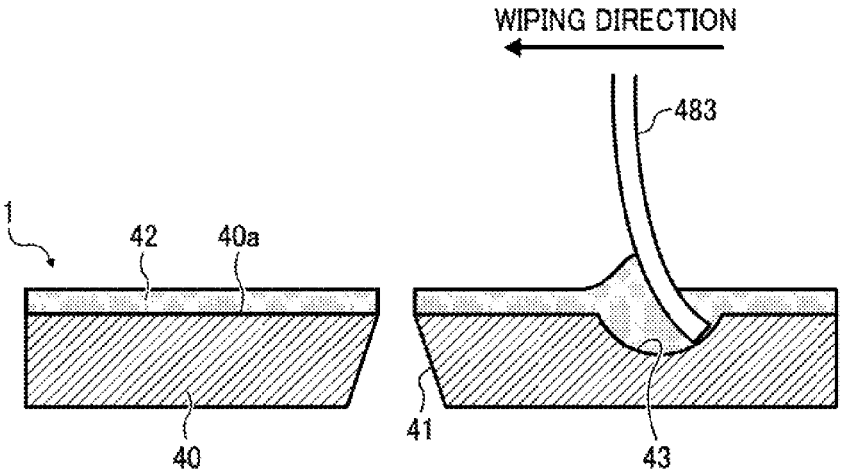
FIG. 9 is a cross section illustrating working of the first embodiment.

Next, the working of the embodiment is described with reference to FIG. 9. FIG. 9 is a cross section illustrating the working.

In the device to discharge a liquid using this liquid discharging head, the nozzle surface (the surface of the liquid repellency film 42 in this case) is wiped by the wiping member (wiper) 483 made of an elastic member to maintain and restore the performance of the liquid discharging head.

As illustrated in FIG. 9, a wiping member 483 enters inside the dimple 43 to scrape the liquid repellent material of the liquid repellency film 42 held inside the dimple in a flowable manner.

Therefore, if the liquid repellency film 42 around the nozzle 4 becomes thin or is peeled off by the wiping, the liquid repellent material scraped from the dimple 43 moves to the area around the nozzle 4 to recover the liquid repellency film 42.

Accordingly, degradation of the liquid repellency of the liquid repellency film 42 caused by the wiping over time is subdued, thereby maintaining the liquid repellency for a long period of time.

Figure 10:
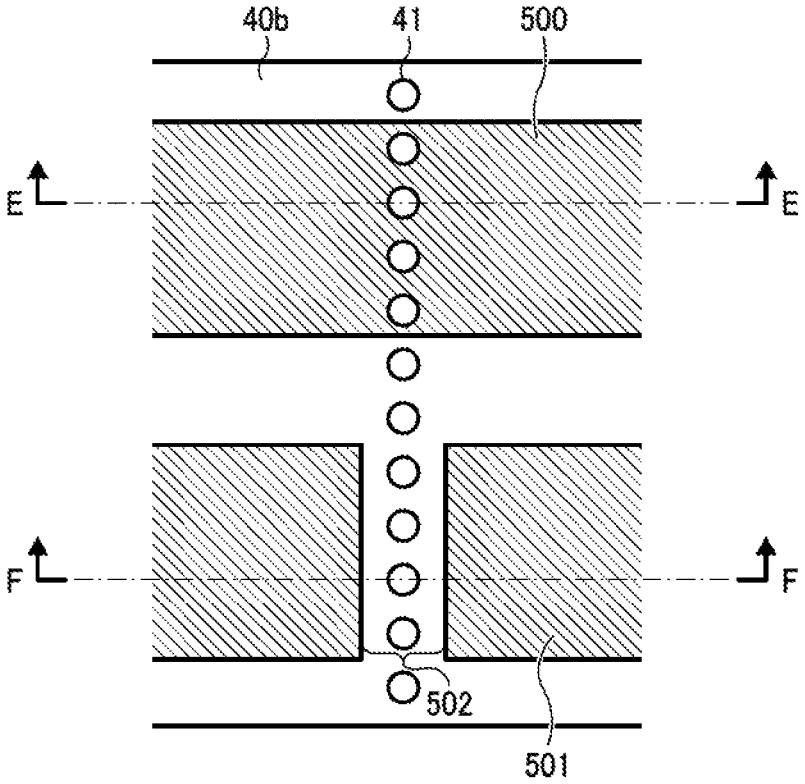
FIG. 10 is a diagram illustrating the discharging surface of the nozzle plate and the opposite surface thereof for use in the description of an example of how to determine whether a liquid repellent material forming a liquid repellent film is held in a flowable manner.
Figure 11:
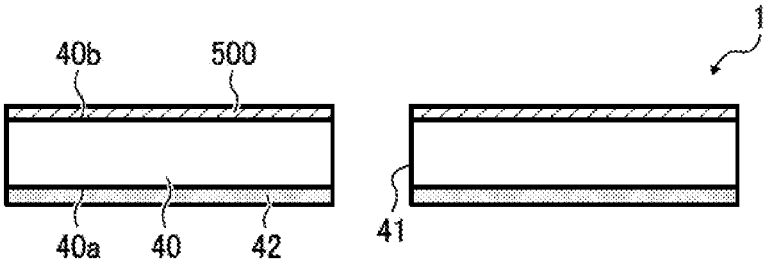
FIG. 11 is a cross section illustrating the liquid discharging head along the line E-E illustrated in FIG. 10.
Figure 12A:
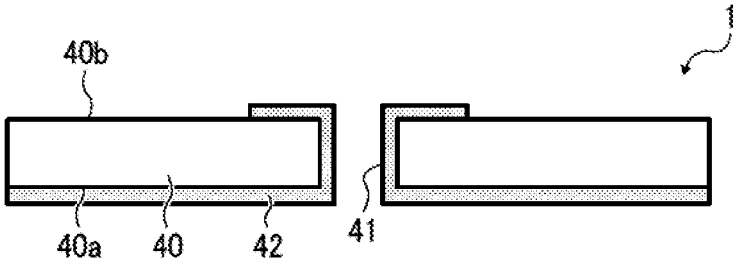
FIGS. 12A and 12B are cross sections illustrating the liquid discharging head along the line F-F illustrated in FIG. 10.

The method of determining whether the liquid repellent material forming the liquid repellency film 42 on the surface of the nozzle plate 1 is held in a flowable manner is described with reference to FIG. 10 to FIG. 12. FIG. 10 is a diagram illustrating the discharging surface of the nozzle plate and the opposite surface thereof. FIG. 11 is a cross section illustrating the liquid discharging head along the line E-E illustrated in FIG. 10. FIG. 12 is a cross section illustrating the liquid discharging head along the line F-F illustrated in FIG. 10.

First, a line 500 crossing the nozzle holes 41 is drawn on the opposite surface 40*b* of the nozzle plate 1 by a felt-tip pen without heating the nozzle plate 1. The liquid repellency film 42 is formed on the discharging surface 40*a*. However, at this point in time, the liquid repellent material is not moved or attached to the opposite side 40*b* so that the line 500 can be drawn around the nozzle hole 41 as illustrated in FIGS. 10 and 11.

Next, the nozzle plate 1 is heated at 120 degrees C. for an hour. If the liquid repellent material of the liquid repellency film 42 has flowability, the liquid repellent material on the discharging surface 40*a* moves to the inside of the nozzle hole 41 by heating as illustrated in 12A. As a consequence, part of the liquid repellent material adheres to the side of the opposite surface 40*b*.

Figure 12B:
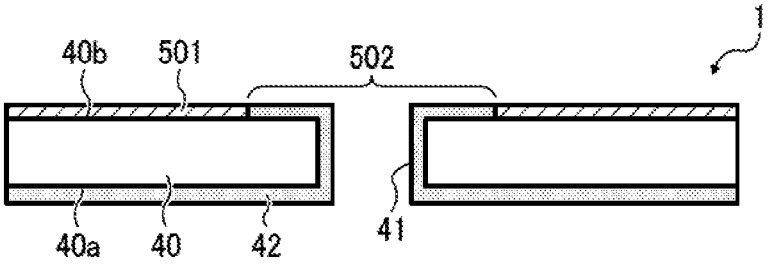

At this point, if a line 501 crossing the nozzle holes 41 is drawn on the side of the opposite surface 40*b* of the nozzle plate 1 by a felt-tip pen after being heated, the line 501 is not drawn around the nozzle hole 41 as illustrated in FIG. 10 and FIG. 12B. That is, the liquid repellent material is fluidized and attached around the nozzle hole 41 of the discharging surface 40*a* and the opposite surface 40*b* and consequently, the ink is repelled so that the line 501 is intermittently broken in an area 502.

That is, whether the liquid repellent material has flowability can be determined as described above.

Next, one embodiment of the methods of manufacturing the nozzle plate is described with reference to FIG. 13. FIG. 13 is a table showing one example of the methods.

In FIG. 13, the upstream process, the pre-processing process, the film-forming process of the liquid repellency film, the post-processing process, and the downstream process are shown. In addition, a stainless plate is used as an example of the nozzle substrate 40 but the nozzle substrate is not limited thereto.

Upstream Process

The upstream process is to polish the surface of the nozzle substrate 40, that is, the discharging surface from which a liquid is discharged.

A method of polishing the surface (surface on the side of the discharging surface 40*a*) of the nozzle substrate 40 on which the nozzle hole 41 is formed includes polishing the surface of the nozzle substrate 40 by a chemical mechanical polishing (CMP) polishing machine (ultra precision shaking type one side polishing machine) using a polyurethane pad. It is preferable to polish the surface of the nozzle substrate 40 until the surface roughness Ra of the surface of the nozzle substrate 40 becomes 0.1 μm or less while rotating the polyurethane pad at 1 rpm to 20 rpm.

The surface roughness Ra of the discharging surface of the nozzle substrate 40 can be measured according to JIS 0601. For example, a stylus type surface shape measuring instrument (Dektak 150, manufactured by ULVAC Inc.) is suitable for the measurement.

The surface roughness Ra can be adjusted by changing, for example, the pressure when pressing the surface of the nozzle substrate 40 with the polyurethane pad, the rotation speed (rpm: the number of rotation per minute) when rotating the polyurethane pad, the flowing amount of the polish liquid, the polishing time, etc.

The dimple 43 is formed in the polishing process of polishing the discharging surface of the nozzle substrate 40.

Pre-Processing Process

The pre-processing process is to treat the nozzle substrate 40 whose surface has been polished, which is ultrasonic wave washing. In addition to the ultrasonic wave washing, wet washing such as scrubbing washing, shower washing (high pressure spray washing, ultrasonic shower washing), dipping washing (flowing water washing, jet flowing washing, bubbling washing), and evaporation washing are also suitable.

Layer Forming Process of Liquid Repellency Film

The layer-forming process of the liquid repellency film 42 is as follows:

First, a dipping liquid including PFPE is prepared to form the liquid repellency film 42.

The surface of the nozzle substrate 40 which has been treated with the pre-processing, that is, the discharging surface of droplets is subject to plasma treatment. Other than the plasma treatment, it is possible to conduct dry washing such as vacuum washing (ion beam washing), normal pressure washing (UV ozone washing, ice scrubber washing, laser washing).

Thereafter, the thus-prepared dipping liquid is applied to the nozzle substrate 40 according to a dipping method. After leaving at normal temperature (about 25 degrees C.), the system is heated followed by ultrasonic wave washing to remove extra perfluoro polyether. By the ultrasonic wave washing, the extra perfluoro polyether is removed so that the thickness of the liquid repellency film 42 is adjusted to a single molecule level, which is preferable.

It is possible to use a liquid in which a perfluoropolyether derivative is dissolved in a fluorine-containing solvent and diluted to 1 percent by mass or less as the dipping liquid of the liquid repellency film 42. It is preferable that the perfluoropolyether derivative has a polar group at its end. Specific examples of the polar group include, but are not limited to, —OH, C═O, —COOH, $—NH_2$, $—NO_2$, $—NH_3^+$, and —CN.

This polar group is bonded with the nozzle substrate or the base coat layer thereon.

As the fluorine-containing solvent, Novec™ (manufactured by Sumitomo 3M), Vertrel® (manufactured by E. I. du Pont de Nemours and Company), and Galden® (manufactured by Solvay Solexis) can be used.

The discharging surface of the nozzle substrate 40 is subject to oxygen plasma treatment.

The film of the liquid repellency film 42 is formed by, for example, dipping the nozzle plate 40 in a solvent, pulling it up, naturally drying it in a normal temperature environment, and heating it for fixing. The heating temperature and the heating time can be changed to a particular application.

Post-Processing Process

The post-processing process is as follows: To protect the surface of the liquid repellency film 42, the discharging surface is covered with a laminate material (laminate processing) and the reverse side of the nozzle substrate 40, that is, the opposite side of the discharging surface, is subject to plasma treatment.

Downstream Process

The downstream process is optional including attaching the nozzle plate 1 with the member constituting the liquid chamber, etc. followed by heating to strengthen the attachment force.

The nozzle plate 1 obtained in the post-processing process is attached to the flow path plate using a low temperature curing type epoxy-based adhesive in the attachment process included in the downstream process. It is preferable to conduct heating and pressure bonding to maintain the attachment state for an extended period of time.

Next, the method of manufacturing the nozzle substrate constituting the nozzle plate is described in detail.

The surface on the side of the discharging surface of the nozzle substrate 40 is polished by, for example, a chemical mechanical polishing (CMP) polishing machine (ultra precision shaking type one side polishing machine) using a polyurethane pad. When polishing, it is preferable to polish the surface while being pressed under a pressure of from 5 kPa to 20 kPa. In addition, when polishing, it is preferable to conduct polishing with a polish liquid prepared by adding a minute amount of particles of alumina, etc. to a polish slurry diluted with pure water.

It is preferable to polish the surface of the nozzle substrate 40 until the surface roughness Ra of the nozzle substrate 40 becomes 0.1 μm or less while rotating the polyurethane pad at 1 to 20 rpm. After such polishing, myriad of the dimples 43 are formed on the polished surface of the nozzle substrate 40.

The dimple 43 has, for example, a diameter of from 80 μm to 120 μm and a depth of 2 μm to 4 μm. It is preferable that the inside wall of the dimple 43 has a gentle slope. The number of the formed dimples 43 can be controlled by the amount of the particle added to the polish liquid or the polishing time.

The added particle preferably has an average particle diameter of from about 90 μm to about 250 μm. For example, alumina particles, silicon carbide particles, and ceramic-based zircon particles can be used.

The surface roughness Ra can be measured according to JIS 0601 as described above. For example, usage of a stylus type surface shape measuring instrument is suitable for the measurement.

Next, durability against wiping in Examples and Comparative Examples is described with reference to FIGS. 14 and 15. FIG. 14 is a diagram for use in a description of the dimple grade and FIG. 15 is a table for use in a description of Examples and Comparative Examples.

First, the nozzle plate 1 was graded according to the number of the dimples 43 formed on the nozzle substrate 40. The surface of the nozzle substrate 40 is observed in the dark field by a metal microscope and the highlighted fine concave portions are counted. Since the size of the dimple 43 is from 80 μm to 120 μm at this point in time, the dimple 43 is easily distinguished from the nozzle hole 41 or scars.

As illustrated in FIG. 14, based on the magnitude relation between the nozzle hole density (a) representing the number of the nozzle holes in a particular length and the dimple density (b) representing the number of the dimples 43 in the particular length along the nozzle arrangement direction when all the dimples 43 located within the range of 150 μm to 10 mm from the nozzle line were projected in the nozzle line direction, the dimples were rated from 0 to 5 as follows:

Grade 0: $(b)=0$
Grade 1: $0<(b)\leq 2a$
Grade 2: $2a<(b)\leq 2.5a$
Grade 3: $2.5a<(b)\leq 3.3a$
Grade 4: $3.3a<(b)\leq 5a$
Grade 5: $(b)>5a$ In the Example illustrated in FIG. 14, (a) is 8 and (b) is 14, the dimple is rated as grade 1.

As illustrated in FIG. 15, the nozzle substrate 40 of Examples 1 to 3 and Comparative Examples 1 to 3 were obtained by changing the content ratio of the aluminum particles contained in the polish liquid used to polish the surface of the nozzle substrate 40. The particle diameter of the aluminum particles was from 90 μm to 250 μm.

The surface roughness Ra of the flat portion other than the dimple 43 in Examples 1 to 3 and Comparative Examples 1 to 3, whether there is a dimple 43, and the dimple grade are as shown in FIG. 15.

As seen in the results of Examples 1 to 3, as the content ratio of the aluminum particles in the polish liquid for use in surface polishing increases, the dimple grade becomes better, resulting in an increase of the number of the dimples.

In addition, although the content of the aluminum particles of Comparative Examples 2 and 3 is the same as that of Example 2, no dimples are formed. In Comparative Examples 2 and 3, the surface of the nozzle substrate is not sufficiently flattened because the polishing time is shorter than that of Example 2. Accordingly, the surface simply becomes coarse but no dimples are formed thereon.

In addition, when the surface roughness Ra of the polished surface was greater than 0.1, it was confirmed that no dimples having a diameter of from 80 μm to 120 μm and a depth of from 2 μm to 4 μm were formed. That is, the dimple 43 is formed when the surface roughness Ra of the polished surface is not greater than 0.1 μm.

The number of wiping was counted until the ink leaving time was 50 seconds or longer to evaluate the durability life against wiping. A larger number of wiping means a longer durability life against wiping. The evaluation results (number of wiping) are shown in the table of FIG. 15.

As seen in the evaluation results of Example 15, the ink leaving time is 50 seconds or longer when the number of wiping is 2,000 times or less in Comparative Examples 1 to 3. To the contrary, the ink leaving time is not longer than 50 seconds when the number of wiping surpasses 2,000 times in Examples 1 to 3, meaning that the durability life against wiping is elongated.

The measuring method of the number of wiping until the ink leaving time reaches 50 seconds is described with reference to FIG. 16. FIG. 16 is a diagram for use in a description of the wiping member (wiper).

As illustrated in FIG. 16, one end of an ethylene propylene (EPDM) rubber blade having a thickness of 1.2 mm, a width of 30 mm, and a length of 20 mm was fixed by a fixing jig 602 with 7 mm out of the length (20 mm) flexible to obtain a wiping member (wiper) 601.

The discharging surface of the nozzle plate 1 is wiped by the wiper 601 at 100 mm/sec while the wiper 601 is made flexible interfering with the discharging surface with 2 mm out of 7 mm. "Interfering with the discharging surface with 2 mm out of 7 mm means that, as illustrated in FIG. 16, if the flexible part is 7 mm of the wiper 601, the length thereof that contacts the discharging surface of the nozzle plate 1 is 2 mm.

The wiper 601 is lowered to the position where it contacts the discharging surface and wipes the discharging surface. Thereafter, the wiper is lifted and separated from the discharging surface and back to the starting position of wiping. Thereafter, the wiper 601 is lowered to contact the discharging surface. This process is repeated.

Next, the measuring method of the ink leaving time of the nozzle plate 1 after wiping is described with reference to FIGS. 17A to 17E.

As illustrated in FIGS. 17A and 17B, a half of the nozzle plate 1 is dipped in an ink 610 and pulled up at 100 mm/sec as illustrated in FIG. 17C. As illustrated in FIG. 17D, withdrawal of the ink 610 from the discharging surface starts immediately after the nozzle plate 1 is pulled up (t=0). The time until the area that the ink 610 covers is reduced to 10 percent of the discharging surface as compared with that immediately after the nozzle plate 1 is pulled up (t=0) is measured, which is defined as the ink leaving time.

As described above, the ink leaving time is measured using the nozzle plate 1 after wiping.

As described above, the suitable number of wiping to obtain the nozzle plate 1 having an ink leaving time of 50 seconds is measured.

The ink composition for use in measuring the ink leaving time is as follows:

The composition having the following recipe was stirred and dissolved at 60 degrees C. and left at room temperature. Thereafter, the solution was adjusted by 10% lithium hydroxide aqueous solution to have a pH of from 9 to 10, which was filtered by polytetrafluoroethylene filter of 0.22 μm to obtain the ink 610.

| Ink 610 | |
|---|---|
| C. I. Direct Black 168 | 3 percent by mass |
| 2-pyrolidone | 3 percent by mass |
| Diethylene glycol | 4 percent by mass |
| Glycerin | 1 percent by mass |
| Alkyl ether carboxylic acid salt-based surfactant (ECTD-3NEX, manufactured by NIHON SURFACTANT KOGYO K.K.) | 0.1% by weight |
| NONIPOL 400 (manufactured by Sanyo Chemical Industries, Ltd.) | 0.5 percent by mass |
| San-ai bac P-100 (manufactured by SAN-AI OIL CO., LTD.) | 0.4 percent by mass |
| Deionized water: | Rest |

The ink 610 had a static surface tension of $25\times1^{-3}$ N/m.

Figure 18:
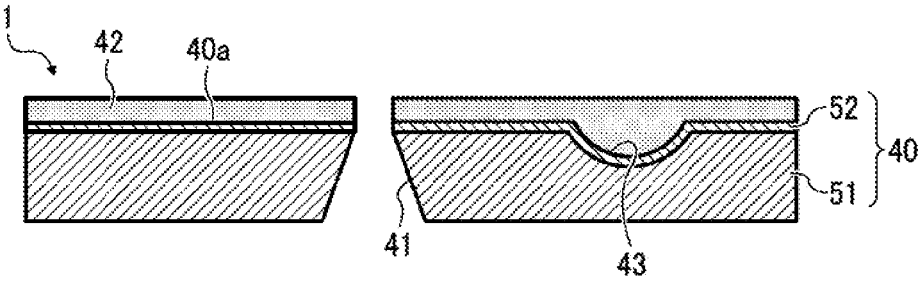
FIG. 18 is a cross section illustrating the nozzle plate in the second embodiment of the present disclosure.

Next, the second embodiment of the present disclosure is described with reference to FIG. 18. FIG. 18 is a cross section illustrating the nozzle plate in the second embodiment of the present disclosure.

In this embodiment, the nozzle substrate 40 includes a substrate 51 and a base coat film (base coat layer) 52 formed on the surface of the substrate 51. The base coat film 52 is to increase the bond between the substrate 51 and the liquid repellency film 42. For example, $SiO_2$ film is suitable. The interface of the nozzle substrate described above is between the base coat film 52 and the liquid repellency film 42 in this embodiment.

Figure 19:
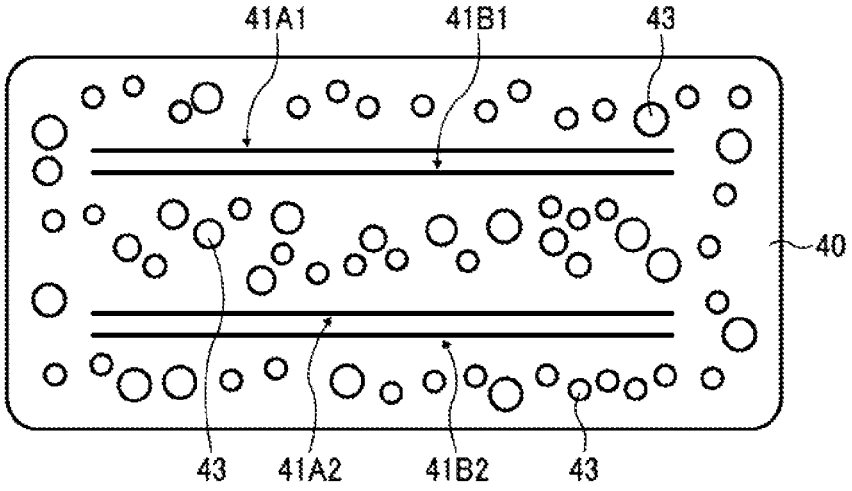
FIG. 19 is a planar diagram illustrating the nozzle plate according to a third embodiment of the present disclosure.

Next, the third embodiment of the present disclosure will be described with reference to FIG. 19. FIG. 19 is a planar diagram illustrating the nozzle plate according to the third embodiment of the present disclosure.

In this embodiment, the nozzle substrate 40 includes four nozzle lines of nozzle hole line 41A1, nozzle hole line 41B1, nozzle hole line 41A2, and nozzle hole line 41B2, on which multiple nozzle holes 41 are arranged. These nozzle hole lines are represented by lines for simplification of the drawing. In this configuration, four nozzle lines are arranged on the nozzle plate corresponding to the nozzle hole lines.

The distance between the nozzle hole line 41B1 and the nozzle hole line 41A2 is greater than that between the nozzle hole line 41A1 and the nozzle hole line 41B1 and that between the nozzle hole line 41A2 and the nozzle hole line 41B2.

In this embodiment, the dimples 43 are also formed between the nozzle hole line 41B1 and the nozzle hole line 41A2.

The liquid repellent material held in the dimples 43 between the nozzle hole line 41B1 and the nozzle hole line 41A2 is supplied around the nozzles 4 on the side of either the nozzle hole line 41B1 or the nozzle hole line 41A2 depending on the wiping direction.

By forming dimples between multiple nozzle lines (nozzle hole lines), it is possible to replenish the liquid repellent material around the nozzle from places closer to the nozzle, thereby maintaining the liquid repellency over a long period of time.

Figure 20:
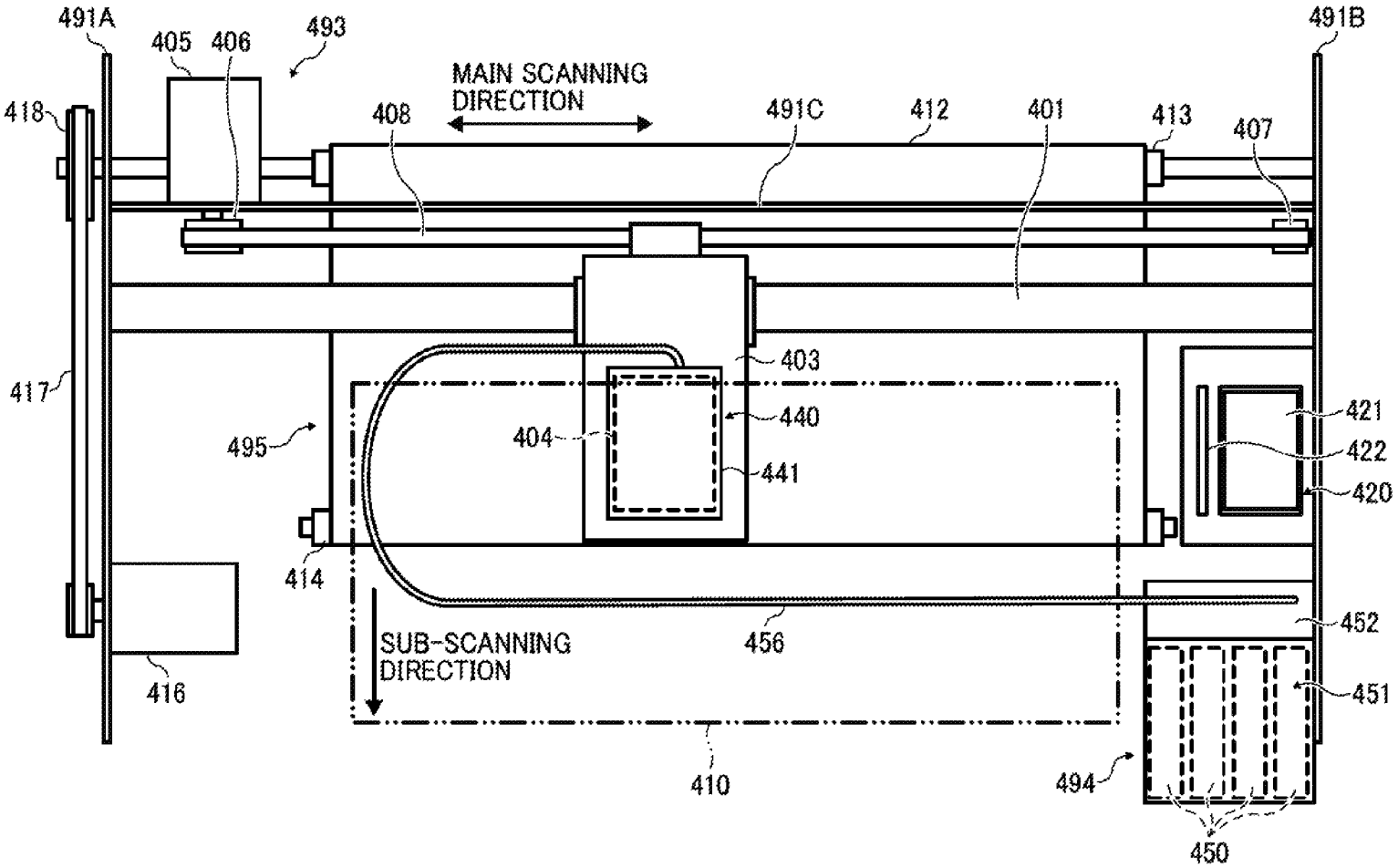
FIG. 20 is a plane diagram illustrating an example of the substantial part of a device to discharge a liquid relating to the present disclosure.
Figure 21:
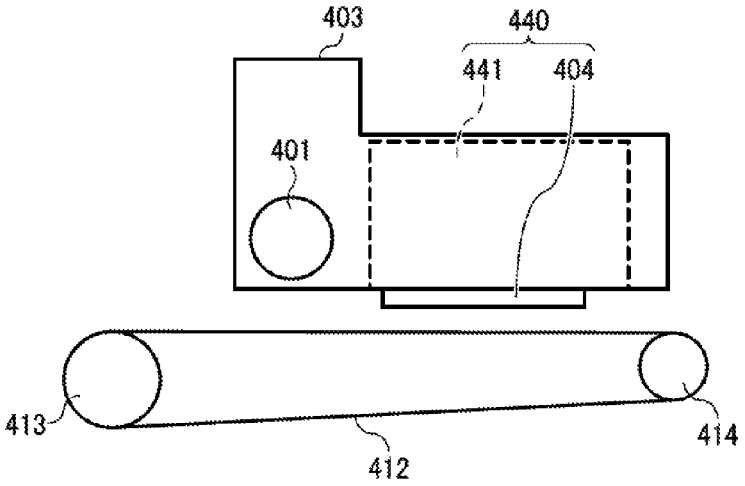
FIG. 21 is a side view of the substantial part illustrated in FIG. 20.

One embodiment of the device to discharge a liquid of the present disclosure is described with reference to FIG. 20 and FIG. 21. FIG. 20 is a plane diagram illustrating an example of the substantial part of the device and FIG. 21 is a side view of the substantial part of the device.

This device is a serial type device and a carriage 403 reciprocates in the main scanning direction by a main scanning moving mechanism 493. The main scanning moving mechanism 493 includes a guiding member 401, a main scanning motor 405, a timing belt 408, etc. The guiding member 401 holds the carriage 403 bridged between the right and left side plates 491A and 491B. The main scanning motor 405 reciprocates the carriage 403 in the main scanning direction via the timing belt 408 bridged between a drive pully 406 and a driven pully 407.

The carriage 403 carries a liquid discharging unit 440 integrally including a head tank 441 and a liquid discharging head 404 of the present disclosure including the nozzle plate.

The liquid discharging head 404 of the liquid discharging unit 440 discharges color liquids of, for example, yellow (Y), cyan (C), magenta (M), and black (K). In addition, the liquid discharging head 404 arranges a nozzle line having multiple nozzle lines in the sub-scanning direction vertical to the main scanning direction with the discharging surface downward.

The liquid stored in a liquid cartridge 450 is supplied to the head tank 441 by the supplying mechanism 494 for supplying the liquid stored outside the liquid discharging head 404 to the liquid discharging head 404.

The supplying mechanism 494 is constituted of a cartridge holder 451 serving as a filling unit where the liquid cartridge 450 is mounted, a tube 456, and a liquid sending unit 452 including a liquid sending pump. The liquid cartridge 450 is detachably attached to the cartridge holder 451. The liquid is sent from the liquid cartridge 450 to the head tank 441 by the liquid sending unit 452 via the tube 456.

This device includes a transfer mechanism 495 to transfer a recording medium 410. The transfer mechanism 495 includes a transfer belt 412 serving as transfer device and a sun-scanning motor 416 to drive the transfer belt 412.

The transfer belt 412 adsorbs the recording medium 410 and transfers it at the position facing the liquid discharging head 404. The transfer belt 412 has an endless form, stretched between a transfer roller 413 and a tension roller 414. The transfer belt 412 is electrostatically adsorbed or aspirated.

The transfer belt 412 moves around in the sub-scanning direction by the transfer roller 413 rotationally driven by a sub-scanning motor 416 via a timing belt 417 and a timing pully 418.

Furthermore, the maintenance and recover mechanism 420 is arranged at the side of the transfer belt 412 on one side of the carriage 403 in the main scanning direction to maintain and recover the liquid discharging head 404.

The maintenance and recovery mechanism 420 includes a capping member 421 to cap a nozzle surface (surface on which the nozzle is formed) of the liquid discharging head 404, a wiping member 421 (wiper) to wipe off the nozzle surface, etc.

The main scanning moving mechanism 493, the supplying mechanism 494, the maintaining and recovery mechanism 420, and the transfer mechanism 495 are installed onto a housing including the side plates 491A and 491B and a back plate 491C.

In the image forming apparatus having such a configuration, the recording medium 410 is fed and adsorbed onto the transfer belt 412 and transferred along the sub-scanning direction by the rotational movement of the transfer belt 412.

By driving the liquid discharging head 404 in response to an image signal while moving the carriage 403 in the main-scanning direction, the liquid is discharged onto the recording medium 410 not in motion to record an image.

Since the liquid discharging head of the present disclosure is provided in this device, quality images can be stably formed.

Figure 22:
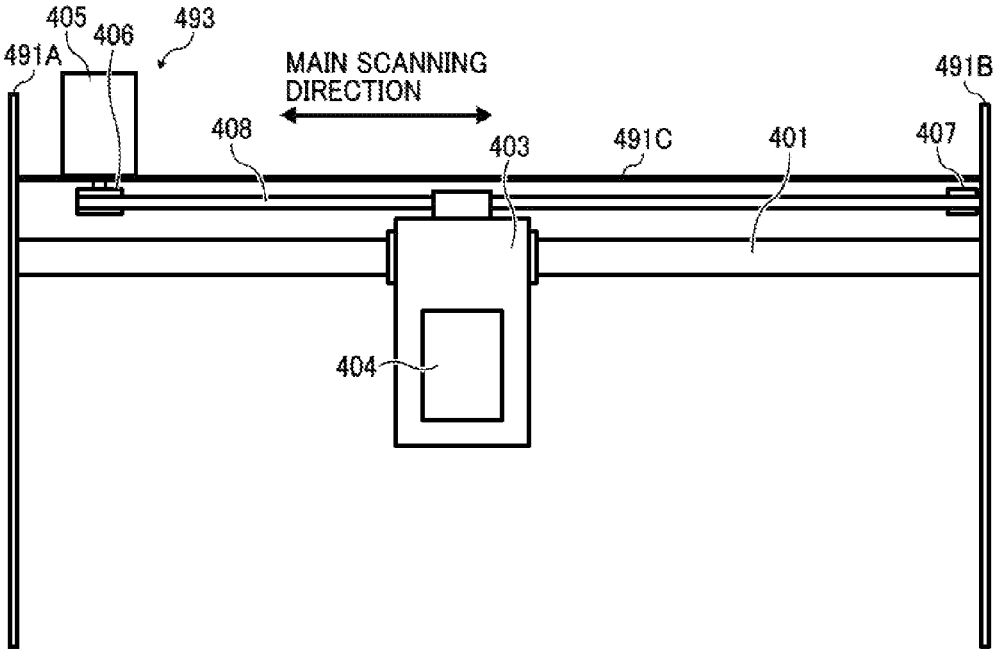
FIG. 22 is a plane diagram illustrating another example of the substantial part of a liquid discharging unit relating to the present disclosure.

Next, another example of the liquid discharging unit of the present disclosure is described with reference to FIG. 22. FIG. 22 is a plane diagram illustrating the substantial part of the liquid discharging unit.

This liquid discharging head is constituted of the housing portion including the side plates 491A and 491B and the back plate 491C, the main scanning moving mechanism 493, the carriage 403, and the liquid discharging head 404 of the members constituting the device to discharge the liquid.

Optionally, a liquid discharging unit can be constituted in such a manner that at least one of the maintenance and recovery mechanism 420 and the supplying mechanism 494 is further attached to, for example, the side plate 491B.

Figure 23:
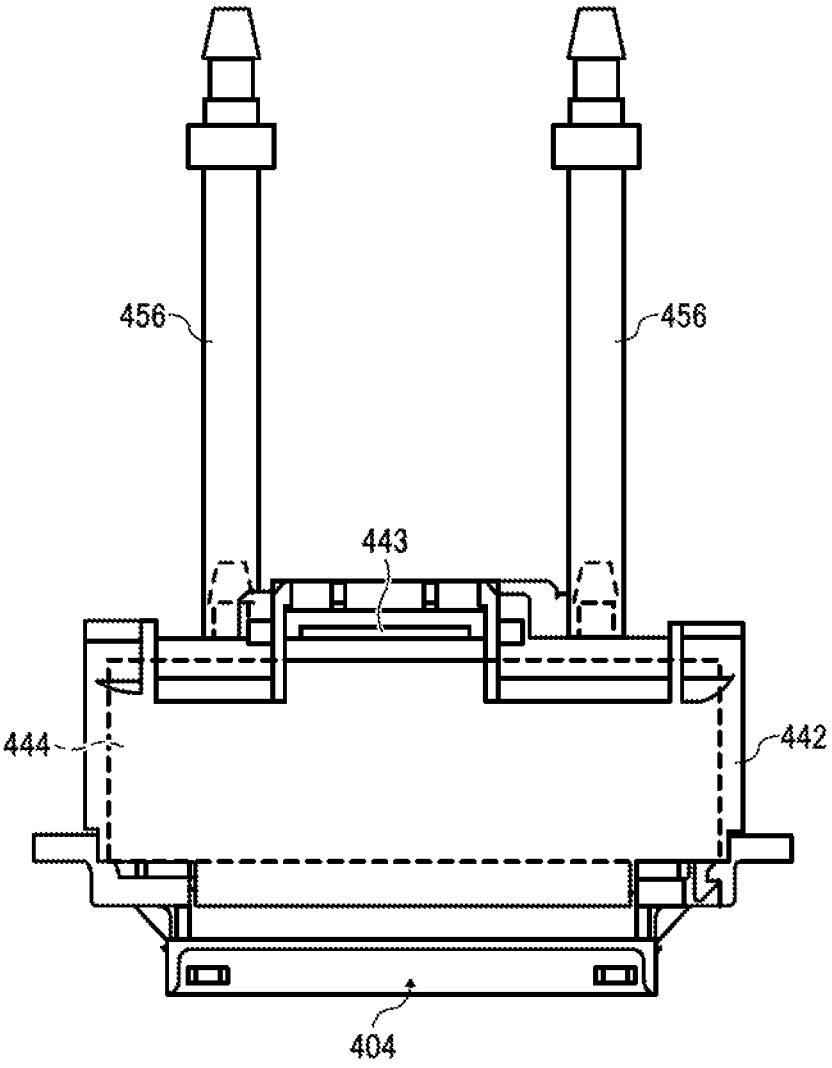
FIG. 23 is a front diagram illustrating yet another example of the substantial part of a liquid discharging unit relating to the present disclosure.

Next, yet another example of the liquid discharging unit of the present disclosure is described with reference to FIG. 23. FIG. 23 is a front view of the liquid discharging unit.

This liquid discharging unit includes the liquid discharging head 404 to which a flow path part 444 is attached and a tube 456 connected with the flow path member 444.

The flow path part 444 is arranged inside a cover 442. The head tank 441 can be included instead of the flow path part 444. In addition, a connector 443 is provided above the flow path part 444 to conduct electric connection with the liquid discharging head 404.

In the present disclosure, the device to discharge a liquid includes a liquid discharging head or a liquid discharging unit and drives the liquid discharging head to discharge the liquid. The device to discharge a liquid includes not only a device capable of discharging the liquid on a medium to which the liquid is attached but also a device that discharges the liquid into air or a fluid.

The device to discharge liquid may include a unit that feeds, transfers, or ejects a medium to which the liquid can be attached, a pre-processing device, a post-processing device, etc.

For example, the device to discharge a liquid includes an image forming apparatus to form images on recording media by discharging ink and a 3D modeling device to discharge a 3D modeling liquid to laminated powder layers.

In addition, the device to discharge a liquid is not limited to those which produce meaningful images such as texts and figures using the discharged liquid. For example, the device to discharge a liquid may form meaningless patterns or 3D objects.

The medium to which the liquid can be attached means those to which the liquid can be attached even temporarily. The material of the medium to which the liquid can be attached is anything to which the liquid can be attached even temporarily. Specific examples thereof include paper, thread, fiber, cloth, leather, metal, plastic, glass, wood, and ceramics.

In addition, the liquid includes ink, processing fluid, DNA sample, resists, pattern materials, binding agents, and modeling liquids.

The device to discharge a liquid includes both a serial type device in which the liquid discharging head is caused to move and a line type device in which the liquid discharging head is not caused to move unless otherwise specified.

In addition, other examples of the device to discharge liquid are a processing fluid applicator to discharge a processing fluid to a recording medium to apply the processing fluid to the surface of the recording medium to reform the surface and a jet granulator to granulate fine particles of raw materials by jetting a liquid composition in which the raw materials are dispersed in a solution through nozzles.

The liquid discharging unit is those in which a functional part and/or a mechanism is integrated in the liquid discharging head, meaning that an assembly of parts relating to liquid discharging. For example, the liquid discharging unit includes a combination of the liquid discharging head and at least one of the head tank, the carriage, the supplying mechanism, the maintenance and recovery mechanism, and the main scanning moving mechanism.

Integration means that, for example, the liquid discharging head is mutually fastened, attached, engaged, etc. with functional parts or mechanism or one is held by the other in a movable manner. In addition, the liquid discharging head and the functional parts or mechanism may be detachably attached to each other.

For example, as the liquid discharging unit, the liquid discharging head and the head tank are integrated like the liquid discharging head 440 illustrated in FIG. 21. In addition, the liquid discharging head can be integrated with the head tank by connection via a tube, etc. Optionally, a unit including a filter may be added between the liquid discharging head and the head tank of these liquid discharging heads.

In addition, the liquid discharging head may be integrated with the carriage as the liquid discharging unit.

In addition, the liquid discharging head may be integrated with a scanning moving mechanism while the liquid discharging head is held in a movable manner by the guiding member constituting a part of the scanning moving mechanism. In addition, as illustrated in FIG. 22, the liquid discharging head, the carriage, and the main scanning moving mechanism may be integrated as the liquid discharging unit.

In addition, while the capping member serving as a part of the maintenance and recovery mechanism is fastened to the carriage onto which the liquid discharging head is installed, the liquid discharging head, the carriage, and the main scanning moving mechanism may be integrated as the liquid discharging unit.

In addition, while the tube is connected with the liquid discharging head to which the head tank or the flow path part is attached, the liquid discharging head and the supplying mechanism may be integrated as illustrated in FIG. 23.

The main scanning moving mechanism includes the guiding member. In addition, the supplying mechanism includes the tube and the installation unit.

In addition, the liquid discharging head has no specific limitation to the pressure generating device thereof. For example, other than the piezoelectric actuator (may use a laminate type piezoelectric element) in the embodiments described above, it is possible to use a thermal actuator using the thermoelectric conversion element such as a heat element and an electrostatic actuator including a vibration plate and a counter electrode.

Moreover, image forming, recording, printing, modeling, etc. represent the same meaning.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

Numerous additional modifications and variations are possible in light of the above teachings. It is therefore to be understood that within the scope of the appended claims, the disclosure of the present invention may be practiced otherwise than as specifically described herein. For example, elements and/or features of different illustrative embodiments may be combined with each other and/or substituted for each other within the scope of this disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC) and conventional circuit components arranged to perform the recited functions.

The present invention can be implemented in any convenient form, for example using dedicated hardware, or a mixture of dedicated hardware and software. The present invention may be implemented as computer software implemented by one or more networked processing apparatuses. The network can comprise any conventional terrestrial or wireless communications network, such as the Internet. The processing apparatuses can compromise any suitably programmed apparatuses such as a general purpose computer, personal digital assistant, mobile telephone (such as a WAP or 3G-compliant phone) and so on. Since the present invention can be implemented as software, each and every aspect of the present invention thus encompasses computer software implementable on a programmable device. The computer software can be provided to the programmable device using any storage medium for storing processor readable code such as a floppy disk, hard disk, CD ROM, magnetic tape device or solid state memory device.

The hardware platform includes any desired kind of hardware resources including, for example, a central processing unit (CPU), a random access memory (RAM), and a hard disk drive (HDD). The CPU may be implemented by any desired kind of any desired number of processor. The RAM may be implemented by any desired kind of volatile or non-volatile memory. The HDD may be implemented by any desired kind of non-volatile memory capable of storing a large amount of data. The hardware resources may additionally include an input device, an output device, or a network device, depending on the type of the apparatus. Alternatively, the HDD may be provided outside of the apparatus as long as the HDD is accessible. In this example, the CPU, such as a cache memory of the CPU, and the RAM may function as a physical memory or a primary memory of the apparatus, while the HDD may function as a secondary memory of the apparatus.

What is claimed is:

1. A liquid discharging head comprising:

a nozzle plate including:

a nozzle substrate having a plurality of nozzle holes to discharge a liquid through the nozzle holes and a plurality of dimples on a discharging surface of the nozzle substrate; and a liquid repellency film formed of a liquid repellent material on the discharging surface of the nozzle substrate, wherein the liquid repellent material is held in a flowable state inside the plurality of dimples, and wherein a diameter of said dimples is in a range of 80 μm to 120 μm and is larger than a diameter of said nozzle holes.

2. The liquid discharging head according to claim 1, wherein the liquid repellent material is a compound having a perfluoropolyether (PFPE) skeleton in a molecule thereof.

3. The liquid discharging head according to claim 1, wherein the dimples are formed on an area distanced from the nozzle holes with a length.

4. The liquid discharging head according to claim 3, wherein the length is 150 μm.

5. The liquid discharging head according to claim 1, wherein the discharging surface of the nozzle substrate has a base coat film as a base coat of the liquid repellent film.

6. A liquid discharging unit comprising:

the liquid discharging head of claim 1.

7. The liquid discharging unit according to claim 6, wherein the liquid discharging head is integrated with at least one of a head tank to store a liquid to be supplied to the liquid discharging head, a carriage to carry the liquid discharging head, a supplying mechanism to supply the liquid to the liquid discharging head, a maintenance and recovery mechanism to maintain and recover the liquid discharging head, or a main scanning moving mechanism to move the liquid discharging head in a main scanning direction.

8. A device to discharge a liquid comprising:

the liquid discharging head of claim 1.

9. A device to discharge a liquid comprising:

the liquid discharging unit of claim 6.

10. The liquid discharging head according to claim 1, wherein the nozzle substrate includes four nozzle lines formed thereon, including two inner nozzle lines sandwiched by two outer nozzle lines, each nozzle line including multiple nozzle holes arranged in a nozzle arrangement direction, and a distance, in a line arrangement direction intersecting the nozzle alignment direction, between the inner nozzle lines is greater than a distance between each inner nozzle line and an outer nozzle line adjacent to said inner nozzle line.

11. The liquid discharging head according to claim 1, wherein one or more dimples are disposed between the inner nozzle lines.

* * * * *